United States Patent [19]

Bryson

[11] 4,059,506

[45] Nov. 22, 1977

[54] ORE TAILINGS TREATMENT

[75] Inventor: Roy E. Bryson, Port Cartier, Canada

[73] Assignee: United States Steel Corporation, Pittsburgh, Pa.

[21] Appl. No.: 580,386

[22] Filed: May 23, 1975

[51] Int. Cl.[2] ..... B03B 5/52

[52] U.S. Cl. ..... 209/18; 209/211; 209/459; 209/493

[58] Field of Search ..... 209/18, 211, 458–460, 209/493, 434

[56] References Cited

U.S. PATENT DOCUMENTS

| | | | |
|---|---|---|---|
| 2,615,572 | 10/1952 | Hodge | 209/211 |
| 2,700,469 | 1/1955 | Humphreys | 209/211 |
| 2,952,360 | 9/1960 | Oberg | 209/211 |
| 3,379,310 | 4/1968 | Reichert | 209/459 |
| 3,568,832 | 3/1971 | Persson | 209/459 |

FOREIGN PATENT DOCUMENTS

| | | | |
|---|---|---|---|
| 247,676 | 11/1962 | Australia | 209/459 |

OTHER PUBLICATIONS

Thompson et al., "The Humphreys Spiral–Some Present and Potential Applications", Engineering and Mining Journal, Aug. 1950, pp. 87–89.

Manual of Operating Instructions, Bulletin No. 10, The Humphreys Investment Co., Denver, Colo., Mar. 3, 1950.

*Primary Examiner*—Frank W. Lutter
*Assistant Examiner*—Ralph J. Hill
*Attorney, Agent, or Firm*—William L. Krayer

[57] ABSTRACT

Ore tailings at the terminus of a spiral concentrator are first split by a novel splitter box into value-rich and value-poor streams determined by the distribution of values therein, and the value-rich stream is upgraded, preferably by passing it through a conical gravity separator.

7 Claims, 7 Drawing Figures

A
B
C
D
E
F
G 1
2
3
4
5
6
7
8
9
10
11
12
13
14
15
16
17
18
19
20
21
22
23
24
25
26
27
28
29
30
32
33
83

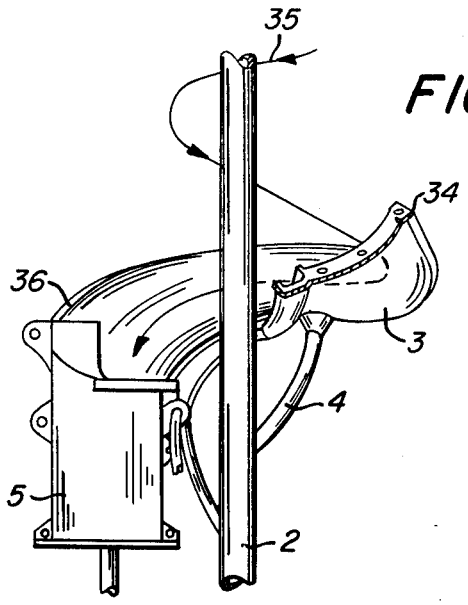
FIG. 3
FIG. 4
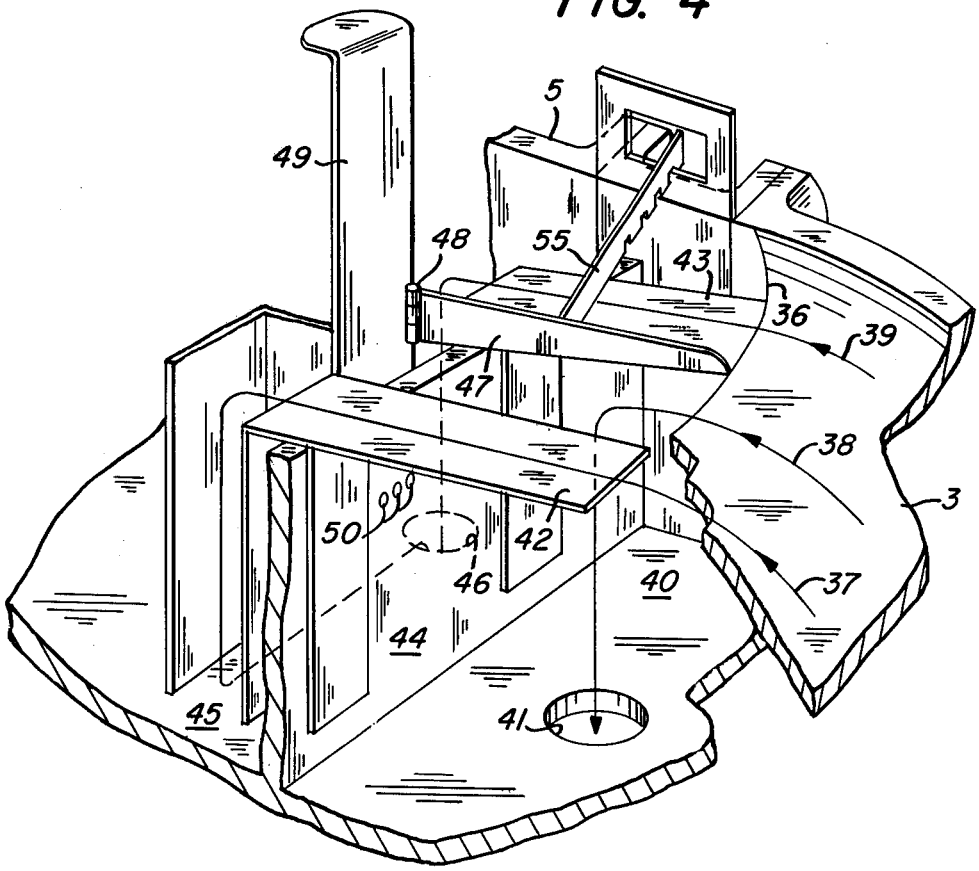

ORE TAILINGS TREATMENT

BACKGROUND OF THE INVENTION

Prior to the present invention, it has been known to beneficiate ore by grinding it and then passing it through a spiral or helical chute concentrator such as described by Humphreys in U.S. Pat. No. 2,431,559. Spiral concentrators commonly in use comprise a trough from about 8 to about 15 inches wide, spiraling downward about 13 inches to 18 inches in a 360° turn, and curving upwards towards the outside edges of the helix substantially as illustrated in the aforesaid Humphreys patent.

When this configuration is used to separate iron values in iron ore, the water carrying the ground ore is allowed to spiral downwardly through the device for, say, four or five turns, during the course of which several drains located on the inside curvature of the helix will drain off the heavier, slower-moving, and generally larger iron-containing solid portions of the ground ore. This portion becomes the concentrate which may be used in various ways for its high percentage of iron. Conventionally, the tailings, or material which reaches the end of the chute without having been drained into the "concentrate", is discarded, even though it may contain from 2% to as much as 25% iron.

The reader may also be interested, with respect to the function of spiral concentrators and certain improvements applied thereto, in reviewing Hendrickson U.S. Pat. Nos. 3,235,081 and 3,235,079; Close, 3,099,621, Vollmer 3,753,491, and Schwartz 3,235,080.

SUMMARY OF THE INVENTION

I have developed methods and apparatus for winning portions of metal values greater than obtainable prior hereto, from the tailings of spiral concentrators employed to concentrate iron ore and/or other types of ore, particularly spiral concentrators of the commerical type including drains on the inside curve of the spiral for collecting concentrate. My invention is applicable to the tailings formed at the discharge end of a spiral concentrator treating any particulate material.

I have discerned, through tests and visual observation, that the discharge end of the trough of a spiral concentrator working on Lac Jeannine iron ore has three distinct streams — an internal, relatively slow, generally gray-colored stream; a central, somewhat faster, pale-colored stream; and the most voluminous, fastest flowing, reddish, outside stream.

As is known in the art, separations in a spiral concentrator are influenced, inter alia, by the concentration of solids, the various mesh sizes, the shapes of the particles, the specific gravities of the particles, the curvature and pitch of the spiral, and the velocity, quantity and viscosity of the water. Classification of the particles in a spiral concentrator is also influenced by different water flowrates in different portions of the profile of the trough and the centrifugal force therein. Classification of value-rich and value-poor portions will be accomplished in any slurry of crushed or ground value-containing material or mineral including, for example, materials such as coal and pyrite, and ores such as gold, silver, lead, tin, iron, rare earths, nickel, molybdenum, etc. By means of numerous observations and assays, I have determined that iron in Lac Jeannine ore is distributed in the spiral concentrator tailings in a consistent and predictable manner. The same type of distribution may be obtained with any other of the above mentioned crushed or ground materials.

As may be seen from Table I, the central stream of the tailings contains the least iron, both in absolute terms and per ton of solids.

Table I must be analyzed with reference to FIG. 1, which is a representation of the profile of the end of a trough of a spiral concentrator working on Lac Jeannine ore. At the end of the spiral, which the figure represents in profile, most of the iron has been removed in the concentrate, as will be explained in further detail with reference to FIG. 3.

The entire surface of the discharge end of a spiral concentrator was divided into seven areas approximately equal in dimension, which are designated as Sections A, B, C, D, E, F, and G in FIG. 1 and the materials in them were collected and analyzed. It is clear from Table I that the relatively iron-rich values in the tailings are found primarily on the outer perimeter of the helix, that is, in Sections A-C, or A-D, roughly, and the rest of the material is relatively iron-poor although the concentration of iron improves somewhat toward the inside of the helix, i.e., Section G.

The sections A-G of the trough are set forth on the left side of Table I and the mesh size distribution across the tops of the vertical column. In each block is shown first the weight percent for each respective mesh size in the tails, and the iron assay is shown below the weight percent, except for sections E, F, and G. The iron assay for these sections was performed only on the totals in the far right column and a combined E-G data set at the bottom of the table. The designation LTPH means long tons of solids per hour.

TABLE I

Distribution of Iron in Rougher Spiral Tailings from Lac Jeannine Ore

| SAMPLE | MESH SIZE 8 | 10 | 14 | 20 | 28 | 35 | 48 | 65 | 100 | 150 | 200 | 270 | 325 | −325 | | TOTAL |
|---|---|---|---|---|---|---|---|---|---|---|---|---|---|---|---|---|
| A | 2.1 | 3.6 | 0.7 | 0.4 | 0.9 | 1.9 | 3.9 | 8.7 | 9.9 | 10.8 | 12.1 | 10.5 | 7.7 | 26.8 | % Wt. | 100.0 |
| | 7.1 | 6.8 | 6.7 | 5.7 | 4.8 | 3.9 | 3.7 | 5.9 | 8.6 | 11.2 | 15.2 | 19.8 | 22.0 | 24.9 | % Fe | 16.1 |
| | % Solids 3.1 | | | | | LTPH 5 | | | | | | Sp. G. Pulp 1.01 | | | | |
| B | 6.9 | 12.8 | 2.3 | 0.4 | 0.7 | 1.2 | 2.2 | 5.0 | 7.7 | 9.6 | 10.4 | 9.1 | 6.6 | 25.1 | % Wt. | 100.0 |
| | 10.4 | 10.0 | 7.7 | 7.2 | 6.1 | 3.2 | 2.9 | 3.2 | 3.1 | 5.3 | 11.3 | 19.1 | 22.3 | 24.6 | % Fe | 14.0 |
| | % Solids 3.0 | | | | | LTPH 8.5 | | | | | | Sp. G. 1.04 | | | | |
| C | 3.5 | 13.6 | 11.3 | 6.7 | 7.8 | 6.7 | 5.9 | 6.3 | 7.6 | 6.4 | 5.6 | 4.3 | 3.0 | 11.3 | % Wt. | 100.0 |
| | 13.4 | 8.6 | 6.0 | 3.9 | 2.8 | 2.0 | 1.7 | 1.7 | 2.1 | 5.2 | 13.3 | 21.7 | 25.2 | 25.1 | % Fe | 7.9 |
| | % Solids 11.5 | | | | | LTPH 20 | | | | | | Sp. G. 1.10 | | | | |
| D | 0.8 | 7.0 | 17.1 | 17.6 | 19.3 | 12.5 | 8.3 | 5.3 | 3.8 | 2.5 | 1.7 | 1.1 | 0.7 | 2.3 | % Wt. | 100.0 |
| | 8.1 | 6.6 | 5.4 | 4.3 | 3.2 | 2.7 | 1.8 | 1.9 | 2.5 | 5.6 | 15.1 | 24.6 | 26.7 | 27.2 | % Fe | 5.1 |
| | % Solids 30.3 | | | | | LTPH 39 | | | | | | Sp. G. 1.22 | | | | |
| E | 0.3 | 0.6 | 4.5 | 13.3 | 26.8 | 21.8 | 14.3 | 8.5 | 4.5 | 2.1 | 1.1 | 0.6 | 0.4 | 1.2 | % Wt. | 100.0 |

TABLE I-continued

Distribution of Iron in Rougher Spiral Tailings from Lac Jeannine Ore

| SAMPLE | MESH SIZE 8 | 10 | 14 | 20 | 28 | 35 | 48 | 65 | 100 | 150 | 200 | 270 | 325 | −325 | TOTAL | |
|---|---|---|---|---|---|---|---|---|---|---|---|---|---|---|---|---|
| | | | | | | | | | | | | | | | % Fe | 5.1 |
| F | — | 0.6 | 2.3 | 6.6 | 21.2 | 23.6 | 20.3 | 13.2 | 6.4 | 2.8 | 1.5 | 0.7 | 0.3 | 0.5 | % Wt. | 100.0 |
| | | | | | | | | | | | | | | | % Fe | 6.0 |
| G | — | 1.6 | 2.4 | 3.4 | 13.5 | 21.2 | 22.2 | 18.5 | 9.4 | 4.0 | 1.9 | 0.9 | 0.4 | 0.6 | % Wt. | 100.0 |
| E-G | 0.1 | 0.7 | 5.9 | 14.5 | 26.9 | 20.3 | 13.9 | 8.4 | 4.4 | 2.0 | 1.2 | 0.6 | 0.3 | 0.8 | % Wt. | 100.0 |
| TOTALS | — | 22.4 | 12.0 | 6.8 | 4.0 | 2.0 | 1.9 | 2.2 | 2.7 | 6.4 | 25.6 | 40.2 | 39.2 | 34.6 | % Fe | 5.8 |
| | % Solids 49.2 | | | | | LTPH 47 | | | | | | Sp. G. 1.43 | | | | |

TABLE II

| Mesh Size | Water Fraction (58.27%) Distribution by Mesh Size -Wt. % | % Fe | Fe Units - Dist. Wt. % × % Fe × 58.27 × 100 | Sand Fraction (41.63%) Distribution by Mesh Size -Wt. % | % Fe | Fe Units - Dist. Wt. % × % Fe ×41.63 × 100 | Total Mill Tails Distribution by Mesh Size -Wt. % | % Fe | Fe Units - Dist. Wt. % × % Fe × 100 |
|---|---|---|---|---|---|---|---|---|---|
| 8 | 0.6 | 3.0 | 1.049 | | | | .35 | 8.0 | 2.80 |
| 10 | 7.1 | 8.3 | 34.338 | 1.0 | 7.2 | 2.997 | 4.56 | 8.21 | 37.44 |
| 14 | 9.4 | 7.1 | 38.889 | 10.8 | 6.9 | 31.023 | 9.98 | 7.00 | 69.86 |
| 20 | 6.7 | 6.0 | 23.425 | 19.5 | 5.8 | 47.083 | 12.03 | 5.69 | 68.45 |
| 28 | 11.0 | 4.6 | 29.485 | 28.1 | 4.1 | 47.962 | 18.12 | 4.30 | 77.92 |
| 35 | 11.8 | 3.2 | 22.003 | 18.3 | 2.8 | 21.331 | 14.51 | 2.98 | 43.24 |
| 48 | 9.4 | 2.5 | 13.693 | 10.8 | 2.2 | 9.891 | 9.98 | 2.37 | 23.65 |
| 65 | 7.9 | 2.5 | 11.508 | 5.9 | 2.3 | 5.649 | 7.06 | 2.43 | 17.16 |
| 100 | 6.9 | 4.1 | 16.485 | 2.6 | 3.1 | 3.355 | 5.06 | 3.87 | 19.58 |
| 150 | 6.3 | 4.5 | 16.519 | 1.1 | 6.8 | 3.114 | 4.13 | 4.77 | 19.70 |
| 200 | 5.5 | 15.1 | 48.393 | 0.5 | 9.1 | 1.894 | 3.41 | 14.70 | 50.13 |
| 270 | 5.7 | 21.8 | 72.406 | 0.3 | 12.4 | 1.549 | 3.44 | 21.50 | 73.96 |
| 325 | 4.7 | 24.4 | 66.824 | 0.3 | 18.1 | 2.261 | 2.86 | 24.30 | 69.50 |
| −325 | 7.0 | 24.4 | 99.525 | 0.8 | 23.0 | 7.660 | 4.41 | 24.30 | 107.16 |
| | 100 | 8.45 | 492.38 | 100 | 4.45 | 185.25 | 100 | 6.77 | 677 |

TABLE III

| Mesh Size | Water Fraction (54%) Distribution by Mesh Size -Wt. % | % Fe | Fe Units - Dist. Wt. % × % Fe × 54 × 100 | Sand Fraction (46%) Distribution by Mesh Size -Wt. % | % Fe | Fe Units - Dist. Wt. % × % Fe × 46 × 100 | Total Mill Tails Distribution by Mesh Size -Wt. % | % Fe | Fe Units - Dist. Wt. % × % Fe × 100 |
|---|---|---|---|---|---|---|---|---|---|
| 8 | 1.8 | 8.2 | 7.97 | | | | 0.97 | 8.2 | 7.95 |
| 10 | 10.0 | 7.9 | 42.66 | 2.3 | 9.0 | 9.52 | 6.46 | 8.1 | 52.33 |
| 14 | 9.4 | 7.2 | 36.55 | 13.6 | 7.4 | 46.29 | 11.33 | 7.5 | 84.97 |
| 20 | 8.2 | 6.9 | 30.55 | 22.5 | 6.0 | 62.10 | 14.78 | 6.26 | 92.52 |
| 28 | 13.5 | 4.8 | 34.99 | 25.8 | 4.2 | 49.84 | 18.16 | 4.40 | 79.90 |
| 35 | 12.6 | 3.5 | 23.81 | 17.8 | 2.8 | 22.93 | 14.98 | 3.10 | 46.44 |
| 48 | 9.2 | 2.0 | 9.94 | 9.4 | 2.4 | 10.38 | 9.29 | 2.17 | 20.16 |
| 65 | 7.1 | 2.2 | 8.43 | 4.2 | 2.2 | 4.25 | 5.76 | 2.18 | 12.56 |
| 100 | 6.0 | 3.8 | 12.31 | 2.1 | 3.5 | 3.38 | 4.20 | 3.71 | 15.58 |
| 150 | 5.0 | 9.5 | 25.65 | 0.7 | 7.2 | 2.32 | 3.02 | 9.30 | 28.09 |
| 200 | 3.9 | 18.5 | 38.96 | 0.5 | 14.5 | 3.33 | 2.34 | 18.30 | 42.82 |
| 270 | 4.5 | 25.3 | 61.48 | 0.2 | 21.9 | 2.01 | 2.52 | 26.20 | 66.02 |
| 325 | 4.8 | 28.5 | 73.87 | 0.2 | 24.8 | 2.28 | 2.68 | 28.4 | 76.11 |
| -325 | 4.0 | 30.5 | 65.88 | 0.7 | 28.6 | 9.21 | 2.48 | 30.01 | 74.42 |
| | 100.0 | 8.7 | 473.05 | 100.0 | 4.95 | 227.84 | 98.97 | 6.99 | 699.87 |

TABLE IV

| Mesh Size | Water Fraction (52.6%) Distribution by Mesh Size -Wt. % | % Fe | Fe Units - Dist. Wt. % × % Fe × 52.6 × 100 | Sand Fraction (47.4%) Distribution by Mesh Size -Wt. % | % Fe | Fe Units - Dist. Wt. % × % Fe × 47.4 × 100 | Total Mill Tails Distribution by Mesh Size -Wt. % | % Fe | Fe Units - Dist. Wt. % × % Fe × 100 |
|---|---|---|---|---|---|---|---|---|---|
| 8 | | | | | | | | | |
| 10 | 13.5 | 9.3 | 66.04 | 2.3 | 8.3 | 9.05 | 8.09 | 9.3 | 75.24 |
| 14 | 9.2 | 6.99 | 33.83 | 13.0 | 7.0 | 43.13 | 11.10 | 6.97 | 77.37 |
| 20 | 6.2 | 6.15 | 20.06 | 20.7 | 5.7 | 55.92 | 13.07 | 5.60 | 73.19 |
| 28 | 10.5 | 4.80 | 26.51 | 25.2 | 4.1 | 48.97 | 17.46 | 4.32 | 75.43 |
| 35 | 11.2 | 3.26 | 19.21 | 17.2 | 2.9 | 23.64 | 14.04 | 3.06 | 42.96 |
| 48 | 9.1 | 2.84 | 13.59 | 9.5 | 2.3 | 10.36 | 9.28 | 2.58 | 23.94 |
| 65 | 7.8 | 2.69 | 11.04 | 4.9 | 2.5 | 5.81 | 6.42 | 2.62 | 16.82 |
| 100 | 6.6 | 4.69 | 16.28 | 3.0 | 4.6 | 6.54 | 4.89 | 4.66 | 22.79 |
| 150 | 5.7 | 9.07 | 27.19 | 1.2 | 12.9 | 7.34 | 3.47 | 9.68 | 33.59 |
| 200 | 5.0 | 18.10 | 47.60 | 1.0 | 28.0 | 13.27 | 3.07 | 20.00 | 61.40 |
| 270 | 4.4 | 23.80 | 55.08 | 0.5 | 37.8 | 8.96 | 2.54 | 25.10 | 63.75 |
| 325 | 2.5 | 26.91 | 35.39 | 0.3 | 38.7 | 5.50 | 1.45 | 28.1 | 40.74 |
| −325 | 8.3 | 25.26 | 110.28 | 1.2 | 35.6 | 20.25 | 4.92 | 26.50 | 130.38 |
| | 100 | 9.17 | 482.10 | 100 | 5.46 | 258.74 | 99.8 | 7.38 | 737.60 |

Tables II through IV show the relative consistency of the mesh sizes and iron contents of the mesh sizes; in each case the "total mill tails" section represents the overall tailings from the spirals extending from the outer limit of Section A in FIG. 1 to the limit of section G. The iron content is given for each size. The "water" and "sand" fractions represent approximately one-half each of the solids, the "sand" fraction being taken from various points in Section D to the inner limit of Section G and the "water" fraction extending from the outer limit of Section A to the dividing point in Section D. In each table, the portion of mill tails in each fraction is recited in weight percent.

From Tables II, III and IV, the predictability of distribution of the various mesh sizes, and the iron contents of the portions in the water and sand fractions, may be seen. In both fractions the most Fe units are found in mesh sizes smaller than 100 and, to a lesser degree, larger than 35. In Tables II, III and IV, the last figure in the columns headed "% Fe" is a calculated assay; that is, the total Fe Units divided by the fraction represented. In Table II, for example, the figure 8.45 is the quotient of 492.38 divided by 58.27.

Prior to my invention, it has not been thought economically feasible to upgrade the tailings of the spiral concentrator to a usable product. I have found, however, that there are not only one, but there may be two or more usable portions of the tailings stream which may be upgraded. My invention, including the preferred system for upgrading, will be further discussed with reference to the accompanying drawings, in which FIG. 1 is the profile of the end of a spiral trough, already discussed.

FIG. 3 is a side elevational view of the lower end of a conventional spiral concentrator.

FIG. 4 is a perspective view of my stream splitter, or discharge box, shown attached to the end of a spiral chute.

Figure 5A:
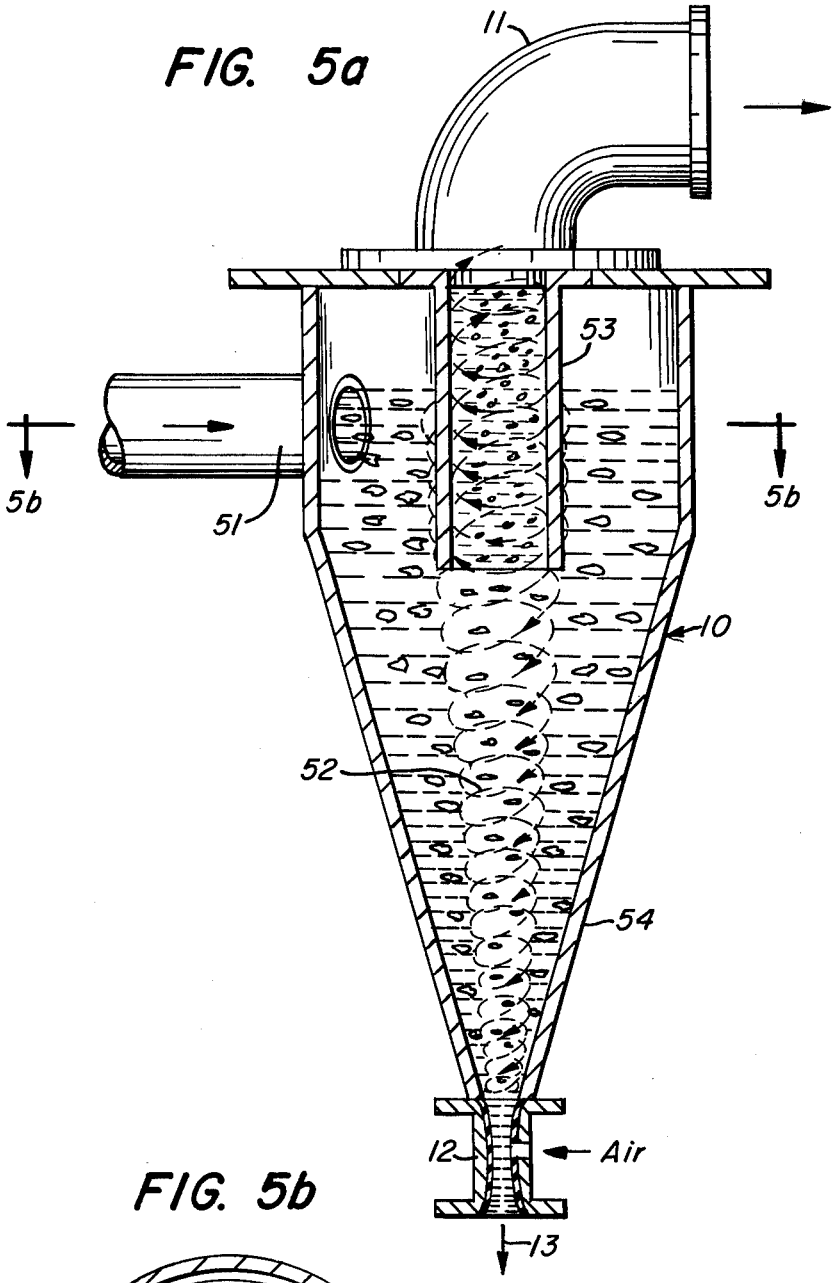
Figure 5B:
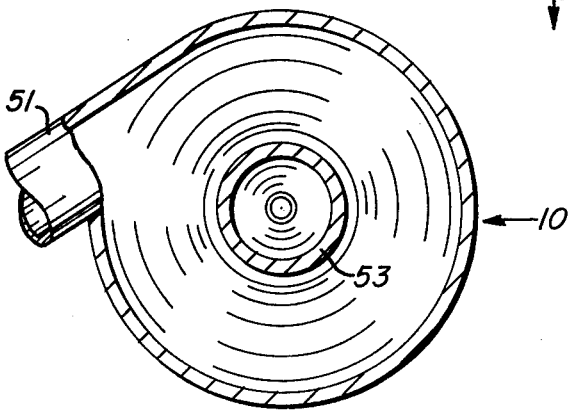

FIG. 5*a* is a side sectional view of a preferred form of dewatering device, the hydrocyclone, FIG. 5*b* is a top sectional view of the hydrocyllone of FIG. 5*a*.

Figure 6:
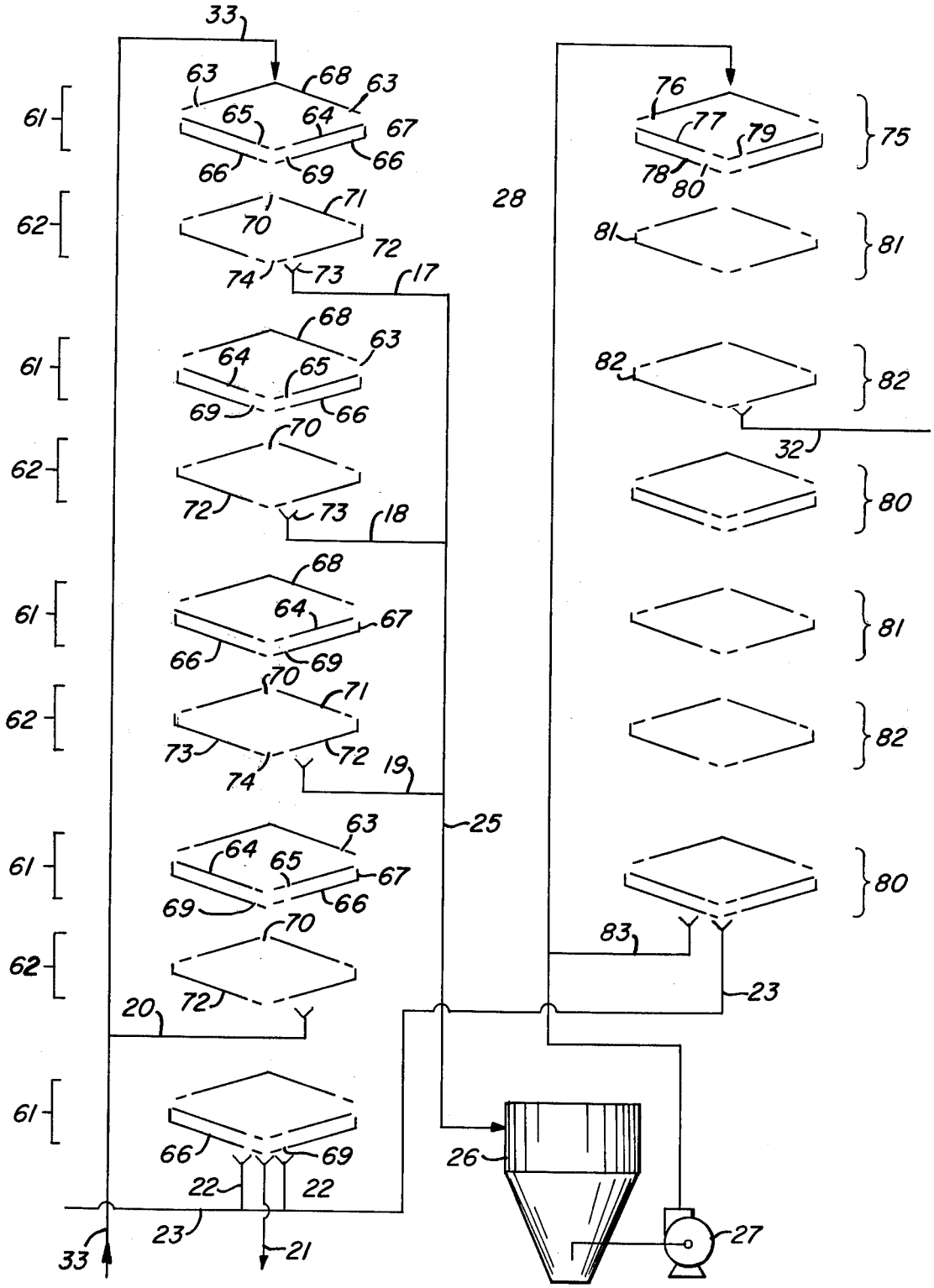

FIG. 6 is a more or less diagrammatic side sectional view of a multi-stage conical gravity separator of the preferred type, showing primary and secondary units.

Figures 1, 2:
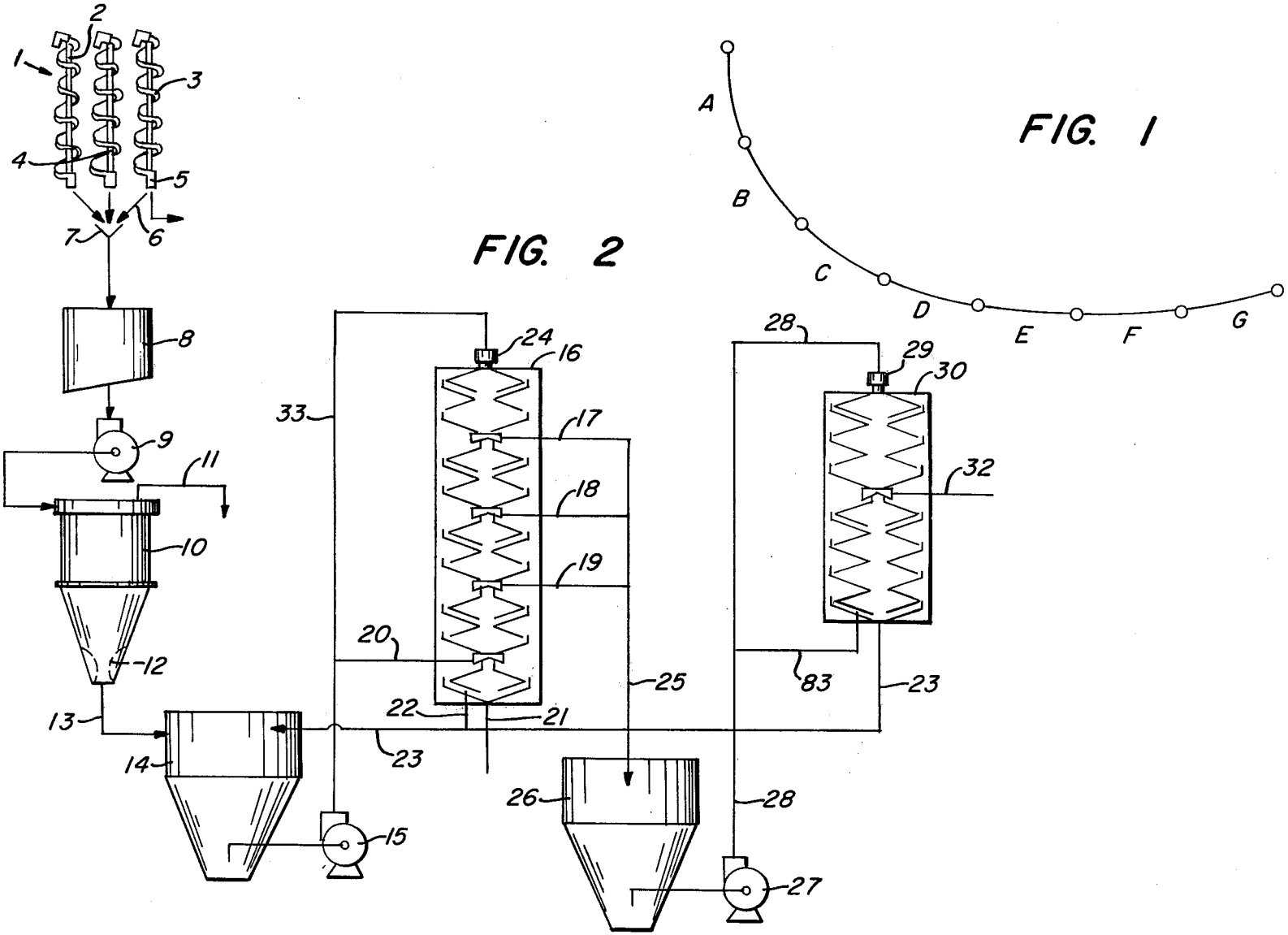
FIG. 2 is a more or less diagrammatic flow sheet of a preferred form of my invention.

Referring now to FIG. 2, iron ore, as an example, ground to about −8 mesh is fed to the tops of a bank of spiral concentrators 1 each having a vertical central concentrate pipe 2 to carry away most of the concentrate collected from the innermost rim of the spiral trough 3 through connecting pipes 4. At the terminus of each trough is a stream splitter 5, which divides the stream in trough 3 into relatively iron-rich portions and a relatively iron-poor portion, as will be explained in greater detail in reference to FIG. 4.

The relatively iron-rich portions are directed through pipes or channels 6 to collector 7 which feeds the stream through a tailing surge tank 8 and pump 9 into one or more hydrocyclones 10. The hydrocyclones 10 are preferably of a type known in the art as a Krebs Model DB-20 cyclone. The incoming feed enters the top side of the cyclone; overflow is drawn off the top in pipe 11 and discarded or used as water for recycling. The "dewatered" solids, or underflow, i.e., a stream containing about 55–68% solids, is drawn off the bottom of the cyclone under the control of the compressed air expansion valve 12 near the lower end, in a known manner. The solids-containing stream containing about 60–70% solids, preferably about 68% solids, is directed through line 13 to a primary concentrator feedbox 14 and from there through pump 15 and line 33 to the inlet 24 of primary multi-stage conical gravity concentrator 16, which will be described in more detail in FIG. 6. Primary conical concentrator 16 has four intermediate concentrate exits 17, 18, 19 and 20, a tails discharge 21 at the bottom, and a middlings exit 22. The middlings are fed through line 23 to the primary concentrator feedbox 14 and back to the inlet of the unit at 24 by way of pump 15. Material in the intermediate concentrate lines 17, 18 and 19 is sent through line 25 to feedbox 26 from which it is sent by pump 27 through line 28 to the top 29 of secondary multi-stage conical gravity separator 30. Middlings collected in line 20 may optionally be returned through line 33 to the top of primary unit 16. The tails of the secondary conical separator 30 are directed back to the primary feedbox 14 by way of line 23. Concentrate from secondary conical separator 30 is directed through line 32 to any of several known devices for further concentration and/or upgrading by known means.

Referring now to FIG. 3, a spiral chute or trough 3 is shown cut away at 34 to illustrate the chute profile. Crushed ore and water follow generally the path 35 from several helical turns above and, as is known, the heavier, generally coarser material collects towards the innermost curve of the helix while the lighter, finer particles and most of the water flows, somewhat more swiftly, toward the outermost portion of the curve. Drains such as 4 collect the coarse concentrate and direct it into a vertical pipe 2 for further processing or use as a concentrated product. As indicated above, normally the material discharge at end 36 of the spiral is sent entirely to a tailings disposal point. My stream splitter box 5 is positioned at the end of the spiral.

FIG. 4 is a cutaway perspective of my stream splitter box 5. At the normal end 36 of the trough 3 the splitter box 5 is butted up against the surface of trough 3 so that the stream in trough 3 is divided into three portions — an inside "sand and iron" fraction 37, a central "sand" fraction 38, and an outside "water" fraction 39 containing fine and coarse iron and most of the water. In the illustrated variation, the central fraction 38 is the first to drop; it proceeds into discharge chamber 40 and thence through sand fraction outlet 41 to be discarded. Fraction 37 and 39 are carried, respectively, by extensions 42 and 43 beyond partition 44 into collection chamber 45 where they are incidentally mixed and then sent through port 46 to line 6 shown in FIG. 2. The positions of extensions 42 and 43 may be made adjustable, and particularly a splitter blade 47 may be hinged at 48 and held with adjustment 55 or the splitter handle 49 may be slidably or adjustably bolted to partition 44 as shown at 50 so as to move all or part of the extension and handle assembly to remove somewhat different fractions from the trough 3.

FIG. 5*a* is a side sectional view of a commercial hydrocyclone 10 which may be used for dewatering the portion of tailings collected and delivered by pump 9 of FIG. 2. Feed from pump 9 enters the hydrocyclone 10 through port 51 tangentially to the wall of the upper cylindrical portion of the unit, where it immediately enters into the formation of a vortex 52 which forms between distending neck 53 and terminal air valve 12 at the lower end of the conical base 54. The unit has an overflow conduit 11 which removes most of the water and superfines of less then 400 mesh. Valve 12 is constricted or dilated in response to increasing or decreasing air pressure. I prefer to so regulate valve 12 to maintain about 68% solids in line 13 when the feed in port 51 is about 8% solids; the excess water is of course emitted through conduit 11.

FIG. 5*b* is a horizontal section of the hydrocyclone through port 51, showing port 51 and neck 53.

FIG. 6 is a side sectional, more or less diagrammatic, view of the primary and secondary multi-stage conical gravity separators which I prefer to use for treating dewatered solids from the collection chamber 45 of FIG. 4. The multi-stage conical separators are shown at 16 and 30 in FIG. 2. They are substantially as described by Reichert in U.S. Pat. No. 3,379,310 and in Graves Mining Congress Journal V. 59, 6, June, 1973, pp. 24–28.

The "rougher" or primary separator 16 comprises five double cone units 61, and four alternating single cone units 62. The flow of the material from pump 15 is directed through line 33 to the apex of the first double cone 61 where it is fanned out into a relatively thin sheet at the outer perimeter of the upper divergent-flow cone 68. The upper or divergent flow cones 68 are typically set at an angle of about 17° and may curve slightly to a steeper angle at the outer edges. A series of slots 63 are positioned near the outer perimeter of the cone in order to cause about half of the water and solids to drop through the initial or upper converging-flow cone 64. Converging-flow cone 64 has a series of slots 65 near its concave apex, through which the heavier, usually iron-containing, particles fall. The second, lower converging-flow cone 66 of double cone 61 has a peripheral flange 67 extending well beyond the outer edge of the upper cone 68, so that material which does not drop through slots 63 and onto upper converging-flow cone 64 will proceed onto lower converging-flow cone 66.

The heavier material or concentrate tends to fall through slots 65 and/or slots 69 and strike the diverging-flow surface 71 of the next single cone 62, while the lighter material passes directly through the opening 70 in the apex of the single cone and onto the surface 68 of the next double cone 61. The concentrate is fanned on the upper conical surface 71 and redirected to converging cone 72, where the slower particles drop through slots 73 and the lighter ones join the tailings through opening 74 on their way to the apex of the next double cone 61. Concentrate is drawn off at 73 and sent through lines 17, 18, 19 and 25 to feeder box 26 and pump 27 to the top of the "cleaner" or secondary stack of cones 30.

Concentrate is also removed from the second and optionally the third single cone units 62 through lines 18 and 19, in each case from slots 73 in bottom cone 72. Middlings in line 22 may be recirculated in line 23. Tailings in line 21 are discarded.

In the secondary, or "cleaner" conical separator 30, the flow of concentrate from line 28 is directed to the apex of initial double cone 75, constructed in the same manner as cones 61 of the primary "rougher" concentrator. An approximately even distribution of material is accomplished by peripheral slots 76 onto converging surfaces 77 and 78, which, by means of slots 79 and 80 separate the material into concentrate and tails as in the rougher concentrator. Tails pass directly through both single cones to the apex of the next double cone 80. Concentrate passes successively to the fanning surfaces of single cones 81 and 82; is collected and removed as product through line 32. Middlings collected at the bottom double cone are sent through line 83 to combine with feed in line 28.

Through the use of my method and apparatus I have been able to obtain increases in the metal recovery in an ore crusher/concentrator plant from typically, 87% without my invention to 91% with it. While average iron content of the water fraction of the spiral concentrator range from about 7% to about 12%, the iron content of my cone concentrator product is about 15% to 18%, well within a range which can be economically recovered by known methods.

In a recent trial, the cone concentrate product contained 16.7% iron, as may be seen from table V.

TABLE V

Iron Recovery from Spiral Tailings

| spiral Concentrators (Plant-Wide) | tph | % Wt. (solids) | % Fe |
|---|---|---|---|
| Tailings | 114 | 100 | 8 |
| Water Fraction | 57 | 50 | 10 |
| Sand Fraction | 57 | 50 | 6 |
| Pilot Plant | | | |
| Cyclone | | | |
| Overflow | 3.0 | 5.3 | 18.0 |
| Underflow | 54 | 94.7 | 9.6 |
| Cones | | | |
| Concentrate | 22.4 | 35.0 | 16.7 |
| Tailings | 41.6 | 65.0 | 5.4 |

It will be apparent to persons skilled in the art that the various valves and controls in my system may be operated by any conventional means. For example, Valve 12 in FIG. 2 may be operated hydraulically rather than pneumatically, and controlled by a device for measuring the solids content of the material in Line 13, such as a gamma ray device. Referring particularly to the splitter box, while any construction having conduit means adapted to recover a water fraction of the tailings near the outside curve of the spiral and conduit means adapted to separate and dispose of a sand fraction centrally or near the inside curve of the discharge end of a spiral concentrator will suit my purposes, the particular structure shown in FIG. 4 showing inside and outside conduit surface extensions and a central gravity conduit, which may be near the inside curve, is preferred.

I do not intend to be restricted to the above specific examples and illustrations. My invention may be otherwise variously practiced within the scope of the following claims.

I claim:

1. A splitter box for recovering value-rich tailings from the discharge end of a spiral concentrator including vertical concentrate collection means comprising (a) central gravity conduit means located centrally or near the inside curve of the discharge end of the spiral for disposing of relatively value-poor tailings, and inner and outer conduit means on both the inside and outside portions of the curve of the discharge end of the spiral for recovering relatively value-rich tailings, and (b) means for bringing together relatively value-rich tailings from both the inner and outer conduit means for further processing.

2. The splitter box of claim 1 in which the outer conduit means comprises an extension of the spiral concentrator surface.

3. The splitter box of claim 1 in which the inner conduit means comprises an extension of the spiral concentrator surface.

4. Method of beneficiating iron ore comprising (a) forming a slurry of crushed and ground iron ore, (b) passing it through a spiral concentrator which separates crushed and ground iron ore into a concentrate collected upstream of the discharge end of said spiral concentrator and a tailings conveyed to the discharge end thereof, said tailings exhibiting a profile across the discharge end of said spiral concentrator, (c) dividing said profile into relatively iron-rich portions near the outside and inside of the curve of the spiral, and a relatively iron-poor portion central of said iron-rich portions, (d) disposing of said iron-poor portion by gravity, (e) conducting the relatively iron-rich portions of said tailings away from said discharge end and (f) bringing together the relatively value-rich portions for further processing.

5. Method of claim 4 followed by the steps of dewatering the relatively iron-rich portions and separating the relatively iron-rich portions into heavy and light fractions in a conical gravity separator.

6. Apparatus for beneficiating metal ore comprising (a) a spiral concentrator having means for removing a concentrate upstream of the discharge end thereof, and (b) a splitter box for recovering value-rich tailings from the discharge end thereof comprising (1) central gravity conduit means located centrally or near the inside curve of the discharge end of the spiral for disposing of relatively value-poor tailings, and inner and outer conduit means on both the inside and outside portions of the curve of the discharge end of the spiral for recovering relatively value-rich tailings, and (2) means for bringing together relatively value-rich tailings from both the inner and outer conduit means for further processing.

7. Apparatus for beneficiating iron ore comprising (a) spiral concentrator having a helical gravity separation trough and a vertical coarse particle collection pipe for collecting concentrate upstream of a tailings discharge end of said trough, (b) a splitter box for recovering value-rich tailings from the discharge end of a spiral concentrator including vertical concentrate collection means comprising (1) central gravity conduit means located centrally or near the inside curve of the discharge end of the spiral for disposing of relatively value-poor tailings, and inner and outer conduit means on both the inside and outside portions of the curve of the discharge end of the spiral for recovering relatively value-rich tailings, and (2) means for bringing together relatively value-rich tailings from both the inner and outer conduit means for further processing, (c) means for conveying the combined relatively iron-rich stream to a dewatering device, (d) a dewatering device for dewatering the iron-rich stream and (e) a multi-stage conical gravity concentrator for separating the dewatered, relatively iron-rich stream into heavy and light fractions thereof.

* * * * *

UNITED STATES PATENT OFFICE

CERTIFICATE OF CORRECTION

Patent No. 4,059,506 Dated November 22, 1977

Inventor(s) Roy E. Bryson

It is certified that error appears in the above-identified patent and that said Letters Patent are hereby corrected as shown below:

Column 4, between lines 9 and 10, Table I, Sample G, under "Total" insert -- %Fe 7.0 --.

Column 5, line 39, change "hydrocyllone" to -- hydrocyclone --.

Column 7, line 26, after "through" insert -- to --.

Column 10, line 5, claim 7, before "spiral" insert -- a --.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*